United States Patent [19]

Katzman

[11] Patent Number: 4,737,382

[45] Date of Patent: Apr. 12, 1988

[54] CARBIDE COATINGS FOR FABRICATION OF CARBON-FIBER-REINFORCED METAL MATRIX COMPOSITES

[75] Inventor: Howard A. Katzman, Los Angeles, Calif.

[73] Assignee: The Aerospace Corporation, El Segundo, Calif.

[21] Appl. No.: 913,161

[22] Filed: Sep. 29, 1986

Related U.S. Application Data

[63] Continuation-in-part of Ser. No. 664,652, Oct. 24, 1984, abandoned.

[51] Int. Cl.[4] ..... B05D 3/02

[52] U.S. Cl. ..... 427/228; 427/384; 427/387; 427/398.1; 427/399; 427/404; 427/419.7; 427/431; 427/443.2

[58] Field of Search ..... 427/228, 384, 387, 443.2, 427/431, 399, 404, 419.7, 398.1

[56] References Cited

U.S. PATENT DOCUMENTS

| | | | |
|---|---|---|---|
| 1,906,963 | 5/1933 | Heyworth | 427/431 |
| 3,493,423 | 2/1970 | Hartwig | 427/431 |
| 4,267,211 | 5/1981 | Yajima et al. | 427/228 |

OTHER PUBLICATIONS

Rashid, "Development of Carbide Coatings for Graphite Filaments" in *American Ceramic Soc. Bulletin,* vol. 51, No. 11, Nov. 1972, pp. 836–839.

*Primary Examiner*—Janyce A. Bell
*Attorney, Agent, or Firm*—William J. Burke

[57] ABSTRACT

A carbon fiber reinforced metal matrix composite is produced by carbide coating the surface of the fibers by passing the fibers through an organometallic solution followed by pyrolysis of the organometallic compounds. The carbide coated fibers, so produced are readily wettable without degradation when immersed in a molten bath of metal matrix material containing an active alloying element.

7 Claims, No Drawings

CARBIDE COATINGS FOR FABRICATION OF CARBON-FIBER-REINFORCED METAL MATRIX COMPOSITES

STATEMENT OF GOVERNMENT INTEREST

The invention described herein may be manufactured and used by or for the Government of the United States for governmental purposes without the payment of royalty therefor.

CROSS REFERENCE TO A RELATED PATENT APPLICATION

This application is a continuation-in-part of application Ser. No. 06/664,652, filed Oct. 24, 1984 now abandoned, entitled "Carbide Coatings for Carbon Fibers."

BACKGROUND OF THE INVENTION

1. Field of the Invention

This invention relates generally to the field of carbon fiber reinforced metal-matrix composites and specifically to fiber coatings that enhance the wettability of the fibers by a molten metal and chemically bond with an alloying metal in the metal matrix.

2. Prior Art

Processes for manufacturing carbon or graphite-fiber-reinforced metal-matrix composites which have relatively high strength-to-weight and stiffness-to weight ratios have traditionally had the problem of graphite fiber resistance to wetting when immersed in molten baths of the metal-matrix material and/or degradation of the fibers during the course of said wetting. Because molten metal does not wet or bond to graphite fibers, it is impossible to achieve load transfer from the matrix to the fibers. What has been required then is a process whereby the fibers could be coated with a material that not only facilitates wetting, but also protects the fibers against chemical degradation during such processing. One of the prior art processes that has been used is chemical vapor deposition (CVD) of a thin film of titanium (Ti) and boron (B) on the fiber to facilitate the wetting, and alloying of (Ti-B) to the matrix metal to reduce migration of the coating as respectively described in U.S. Pat. No. 4,082,864 of Apr. 4, 1978 to Kendall et al, and U.S. Pat. No. 4,223,075 of Sept. 16, 1980 to Harrigan, et al. Such deposition, although a meritorious improvement over other prior art methods, is still relatively expensive and not always consistent as to results. Accordingly, there was a need for a process that would enhance the wettability of graphite/carbon fiber while disallowing degradation during the immersion in the molten bath of the metal matrix material.

This need was partially filled by my prior invention described in U.S. Pat. No. 4,376,803 wherein fibers were coated by a metal oxide derived from an organometallic solution which enhanced the ability of a metal to wet a fiber. That invention was particularly useful for the metal magnesium, but less useful for the metal copper. Accordingly, there was still a need for a process that would particularly enhance the wettability of copper with regards to such fibers.

U.S. Pat. No. 4,267,211 issued May 12, 1981 to Yajima et al teaches the coating of fibers with silicon carbide but does not recognize that if the matrix does not chemically react with the coated fibers then the bond is weak. Furthermore, Yajima does not recognize that the bond between the metal and the coated fibers can be strengthened by alloying the non-reactive base metal with a second reactive metal.

SUMMARY OF THE INVENTION

It is an important object of the invention to uniformly deposit a carbide coating on the surface area of a carbon or graphite fiber to enhance the wetting of the fiber by a metal matrix alloy containing an active element without seriously degrading the characteristics of the fiber during such a process step.

It is yet another important object of invention to use a copper alloy as the metal-matrix material.

It is yet another important object of the invention to alloy the copper with an active metal that will react with the carbide coating on a carbon or graphite fiber, but will not react with the fiber itself.

It is another important object of the invention to pass the fibers through polymeric precursor organometallic compounds to yield the desired carbide coating on the surface of the fiber.

It is a further object of the invention to use silicon carbide as the carbide coating on the fiber.

It is also an important object of the invention to use organosilicon as the organometallic.

It is another further object of the invention to use polycarbosilane as the polymeric precursor organometallic compound.

DESCRIPTION OF THE PREFERRED EMBODIMENT

The fibers used in the embodiment of the present invention are amorphous carbon with relatively high strength and relatively low modulus, or are partially or wholly graphitic with relatively high strength and high modulus. A typical strand of carbon or graphite fiber consists of 1,000 to 12,000 continuous filaments each approximately seven to eleven microns in diameter. These fibers are commercially available under such trade names or trade-marks as FORTAFIL (Great Lakes Carbon Corp.), THORNEL (Union Carbide Corp.) and MODMOR (Whittaker-Mogan, Inc.) The present embodiment uses THORNEL 300 PAN-based on THORNEL P55 pitch-based graphite fibers, but is not limited thereto.

The initial steps in processing the graphite fibers enhances their wettability and infiltration by the metal matrix material. In this step, uniform carbide coatings are deposited on the surface of the fibers by passing the fiber bundles through various organometallic solutions, in particular an organosilicon solution, which act as polymeric precursors. The organometallic compound is then pyrolyzed to yield the desired coating. Those carbide coated fibers are readily wettable when immersed in a molten copper bath containing an active element. Carbide coatings so made form strong chemical bonds with both carbon or graphite fibers and the active element in the metal alloy resulting in composites with good load transfer between the matrix and fibers, relatively higher transverse strength, better corrosion resistance and improved high temperature stability compared with currently produced composites.

In the present embodiment of the invention, the coating process makes use of an organometallic, preferably an organosilicon polymer, acting as a polymeric precursor that converts to carbide, preferably silicon carbide, when heated to a high temperature in an inert atmosphere. The polymer provides a skeleton composed of silicon and carbon which produces silicon carbide upon heating. Polycarbosilane is a specific example of this class of organosilicon polymer compounds. It pyrolyzes at approximately within the range of 1000°-1400° C., per the following formula:

$$(-Si(CH_3)(H)-CH_2-)_n \xrightarrow{heat} nSiC + nCH_4 + nH_2.$$

It will be appreciated that "n" is the number of monomeric units in the polymer which may be from approximately 15 to 30.

An example of the new technique of coating graphite or carbon fibers with silicon carbide utilizing polycarbosilane is now described. Sequentially, the as-received fiber tows pass first through a furnace at an approximate temperature of 450° under an inert gas such as argon to vaporize and remove the fiber sizing. Next, the fibers are passed through an ultrasonic bath containing a toluene solution of polycarbosilane with a concentration within the range of approximately 10-200 grams per liter at a temperature within the range of approximately 20°-60° C. Finally, the fibers are sent through a series of several, but optimally five furnaces containing an inert gas, such as argon, at various increasing temperatures. Those temperatures are within the range of approximately 100°-1200° C., the range in which the toluene is vaporized and the polycarbosilane is pyrolyzed to silicon carbide (SiC) on the fiber surfaces. The thickness of the coating may be from approximately within the range of 700 to 2500 angstroms.

The SiC coated fibers are then immersed in a molten metal bath where the fibers are wetted and infiltrated by a metal alloy. The alloy comprises a metal that is non-reactive with the SiC coating and a minor or trace portion of a second active metal that is reactive with the SiC coating. The reactive metal combines with the fiber coating to provide a chemical bond with the SiC that enhances the mechanical bond of the non-reactive metal with the carbon fibers.

Examples of the non-reactive metals forming the major constituent of the metal alloy matrix material are copper, magnesium and aluminum. Examples of metals serving as active alloying materials in the non-reactive matrix metal are titanium, iron, cobalt, nickel, zirconium, niobium and lanthanum. The active metal is present in the alloy in a concentration in the approximate range of 1 to 10 weight percent. The specific concentration is not critical and is selected in accordance with acceptable or tolerable variations in the purity of the principal non-reactive metal constituent of the alloy as dictated by the use of the ultimate or final product.

It will be further appreciated by way of definition that organosilicon is a subset of organometallics. It will be also noted that polycarbosilane, a polymeric precursor or polymer or polymerized form, is a subset of organosilicon. Heating the appropriate polymers, polymeric precursor or polycarbosilane may be operative to form a carbide, metal carbide, or silicon carbide. It should also be noted that in the preferred embodiment of the present invention, the polymer, polymeric precursor or polycarbosilane state of the organosilicon is that which is used to form the silicon carbide coating.

Features of the invention include the use of orgaometallic polymer precursors such as polycarbosilane to deposit uniform carbide coatings such as silicon carbide on fiber surfaces. An additional feature of the invention is the use of carbide coatings to facilitate wetting of carbon or graphite fibers with various molten metals and in particular copper alloys containing an active element like Titanium.

From the foregoing description of a specific embodiment illustrating the fundamental features of the invention, it will now be apparent to those skilled in the art forms without departing from the true spirit and scope thereof. Accordingly, it is understood that the invention disclosed herein is a preferred embodiment thereof and that the invention is not to be limited thereby, but only by the appended claims.

What is claimed is:

1. A process for fabricating a carbon fiber reinforced metal matrix composite comprising:

a. depositing a silicon carbide coating on the surfaces of the carbon fibers;

b. immersing the silicon carbide coated fibers in a molten bath of a metal matrix material comprising an alloy consisting of a major portion of a metal non-reactive with the silicon carbide and a minor portion of a metal reactive with the silicon carbide coating; and, c. removing the fibers from the bath and solidifying the metal alloy adhered to fibers whereby to form metal matrix adhered chemically and mechanically to the fibers.

2. The process as defined in claim 1 wherein the non-reactive metal in the alloy is selected from the group comprising copper, magnesium and aluminum.

3. The process as defined in claim 1 wherein the non-reactive metal in the alloy is copper.

4. The process as defined in claim 1 wherein the reactive metal in the alloy is selected from the group comprising titanium, iron, cobalt, nickel, zirconium, niobium and lanthanum.

5. The process as defined in claim 1 wherein the reactive metal in the alloy is titanium.

6. The process as defined in claim 1 wherein the non-reactive metal in the alloy is copper and the reactive metal in the allow is titanium.

7. The process as defined in claim 1 wherein the surfaces of the carbon fiber are coated with silicon carbide by:

a. immersing the carbon fiber in an organosilicon polymeric precursor solution to thereby provide a coating of the solution on the surfaces of the fiber; and, b. pyrolyzing the coating of the solution into a coating of silicon carbide.

* * * * *